US006167818B1

(12) United States Patent
Dejanovich

(10) Patent No.: US 6,167,818 B1
(45) Date of Patent: Jan. 2, 2001

(54) CASTABLE CYCLONE DEFLECTOR

(75) Inventor: Daniel Dejanovich, Libertyville, IL (US)

(73) Assignee: Cyclone Combustion Enhancement Group, LLC, Chicago, IL (US)

( * ) Notice: Under 35 U.S.C. 154(b), the term of this patent shall be extended for 0 days.

(21) Appl. No.: 09/352,486

(22) Filed: Jul. 13, 1999

Related U.S. Application Data

(60) Provisional application No. 60/092,891, filed on Jul. 15, 1998.

(51) Int. Cl.[7] ..... F23B 5/00; F23C 9/00

(52) U.S. Cl. ..... 110/264; 110/213; 110/265

(58) Field of Search ..... 110/213, 263, 110/264, 265, 266, 322, 323; 29/890.02; 198/952

(56) References Cited

U.S. PATENT DOCUMENTS 2,576,053 * 11/1951 Toner ..... 110/97
2,800,091 * 7/1957 Lotz ..... 110/28
2,971,480 * 2/1961 Sage ..... 110/28
3,124,086 3/1984 Sage et al. .
4,473,014 * 9/1984 Dejanovich ..... 110/264
4,565,137 * 1/1986 Wright ..... 110/264
4,724,780 * 2/1988 Hoffert et al. ..... 110/263
5,976,445 * 11/1999 Kuroda et al. ..... 264/297.4
5,979,720 * 11/1999 Nomura et al. ..... 222/606
6,031,207 * 2/2000 Dover et al. ..... 219/405

* cited by examiner

*Primary Examiner*—Denise L. Ferensic
*Assistant Examiner*—Ken Rinehart
(74) *Attorney, Agent, or Firm*—Emrich & Dithmar

(57) ABSTRACT

A cyclone furnace includes a cylindrical shaped furnace chamber having an inlet end for the introduction of fuel-air and an outlet end defining a re-entrant throat member. A monolithic deflector cone and orifice member comprised of a castable ceramic refractory material is secured to the re-entrant throat member.

13 Claims, 1 Drawing Sheet

CASTABLE CYCLONE DEFLECTOR

The present application claims the benefit of United States provisional application Serial No. 60/092,891, filed on Jul. 15, 1998.

BACKGROUND OF THE INVENTION

The present invention relates to an improved cyclone deflector cone and orifice member which is mounted to the re-entrant throat of a cyclone furnace to enhance the combustion performance within the cyclone furnace and the exit area of fuel-air particles at the re-entrant throat of the cyclone furnace.

The present invention is an improvement over my U.S. Pat. No. 4,473,014, which issued in my name on Sep. 25, 1984. As described in U.S. Pat. No. 4,473,014, a re-entrant throat extension member is adapted to be fitted to the re-entrant throat of a cyclone furnace/boiler to increase the residence time of the fuel-air mixture within the cyclone boiler assembly and to provide for enhanced combustion of the fuel-air mixture. The re-entrant throat extension member contemplated in accordance with U.S. Pat. No. 4,473,014 is an extension member having a plurality of fluid cooling tubes positioned therein which maintain the cyclone furnace within a controlled operating temperature range. The throat extension member increases the residence time of the fuel-air mixture within the cyclone furnace to provide improved combustion of the fuel-air mixture. However, a cooled re-entrant throat extension member oftentimes does not possess satisfactory properties, such as, resistance to thermal conductivity, resistance to abrasion, resistance to slag, resistance to thermal shock, resistance to oxidation and reducing atmospheres and resistance to carbon monoxide attack. Moreover, the '014 re-entrant throat extension member may not provide the shape and dimensional accuracy necessary to provide the proper deflection of and recycling of fuel particles toward the forward end portion of the wall surface of the cyclone chamber. Thus, the water-cooled re-entrant throat extension member may limit the proper distribution and dispersion of fuel particles through the cyclone.

Finally, the resultant time and costs necessary in retrofitting a cyclone boiler re-entrant throat extension member with water cooling tubes results in significant shutdown time of the cyclone furnace and is very costly. Moreover, the metal water tubes may result in degregation of the extension member after prolonged usage and performance impedance in water circulation in conventional cyclone furnaces.

SUMMARY OF THE INVENTION

It is one object of the present invention to provide re-entrant throat refractory deflector cone and orifice member which possesses improved thermal conductivity and abrasion resistance when installed within a cyclone furnace.

A further object of the present invention is a deflector cone and orifice member which is comprised of a refractory material which possess improved resistance to slag and thermal shock during operation of the cyclone furnace.

Yet another object of the present invention is to provide an improved deflector cone and orifice member which is comprised of a castable refractory material which possesses the requisite integrity of the deflector cone and orifice member shape and which is structured to be retrofitted to the re-entry throat of a cyclone boiler.

It is still another object of the present invention to provide a deflector cone and orifice member which is comprised of a castable ceramic refractory material which is selected from a group comprising chrome containing alumina, zirconia, metals, ceramics and mixtures or blends of these materials.

In accordance with the present invention, the deflector cone and throat member is sized to fit the internal diameter measurements taken of the re-entrant throat of any known cyclone furnace or boiler. After the size, width and dimensions of the re-entrant throat are known, a mold is made to provide the shape of the deflector cone and re-entrant throat member. The shape of the mold provides a monolithic cone having, preferably, more than one segment which are structurally arranged to be fitted together to provide a cylindrical re-entrant throat member and which are self supporting within the re-entrant throat portion of the furnace chamber.

The mold is adapted to receive the castable refractory material and the resultant molded deflector cone and re-entrant throat member consists of two portions, the first portion which forms the cylinder which is adapted to be received within the re-entrant throat of the cyclone furnace and a second portion which is an extension of the throat portion of the cone projecting into the furnace chamber at an angle substantially towards the end corner of the cyclone furnace. The angle of the second portion of the cone within the cyclone furnace ranges between approximately 15° to 20° from the central axis of the furnace. A preferred angle of approximately 17° is desired depending upon the slope of the re-entrant throat. The angle of the second portion away from the central axis is substantially the same as the angle of the re-entrant throat portion towards and with respect to the central axis. Such a relationship provides for the desired retention of the fuel-air mixture within the cyclone furnace to provide enhanced combustion within the furnace chamber.

One significant advantage of the present invention is the capital savings realized when using a deflector cone and re-entrant throat member comprised of a castable ceramic refractory material, rather than forming boiler tubes in the re-entry deflector cone. Moreover, the use of ceramic refractory materials in molding the deflector cone member is faster than rebuilding circulation tubes in the re-entrant throat member of the cyclone furnace and less expensive. Additionally, the heat retentive characteristics of the ceramic refractory throat member improves the operating conditions at the outlet end of the cyclone furnace. During combustion, the ceramic refractory deflector cone member absorbs and retains heat to elevate and sustain the high temperatures at the outlet end of the chamber to thereby provide a more complete burn of the fuel-air mixture as the mixture exits the cyclone furnace chamber. The increased temperature at the outlet end of the cyclone furnace results in an increase in temperature in the vicinity of the slag tap opening thereby facilitating and maintaining a liquid flow of the slag out of the cyclone furnace, a result which enhances the combustion cycle within the cyclone.

Other and additional objects of the present invention will be apparent from the following description and claims that are illustrated in the accompanying drawings which, by way of illustration, show a preferred embodiment of the present invention and the principles thereof and what is now considered to be best mode contemplated in applying these principles. Other embodiments of the present invention employing the same or equivalent principles may be used and structural changes may be made as desired by those skilled in the art without departing from the present invention and the scope of the appended claim.

DETAILED DESCRIPTION

Figure 1:
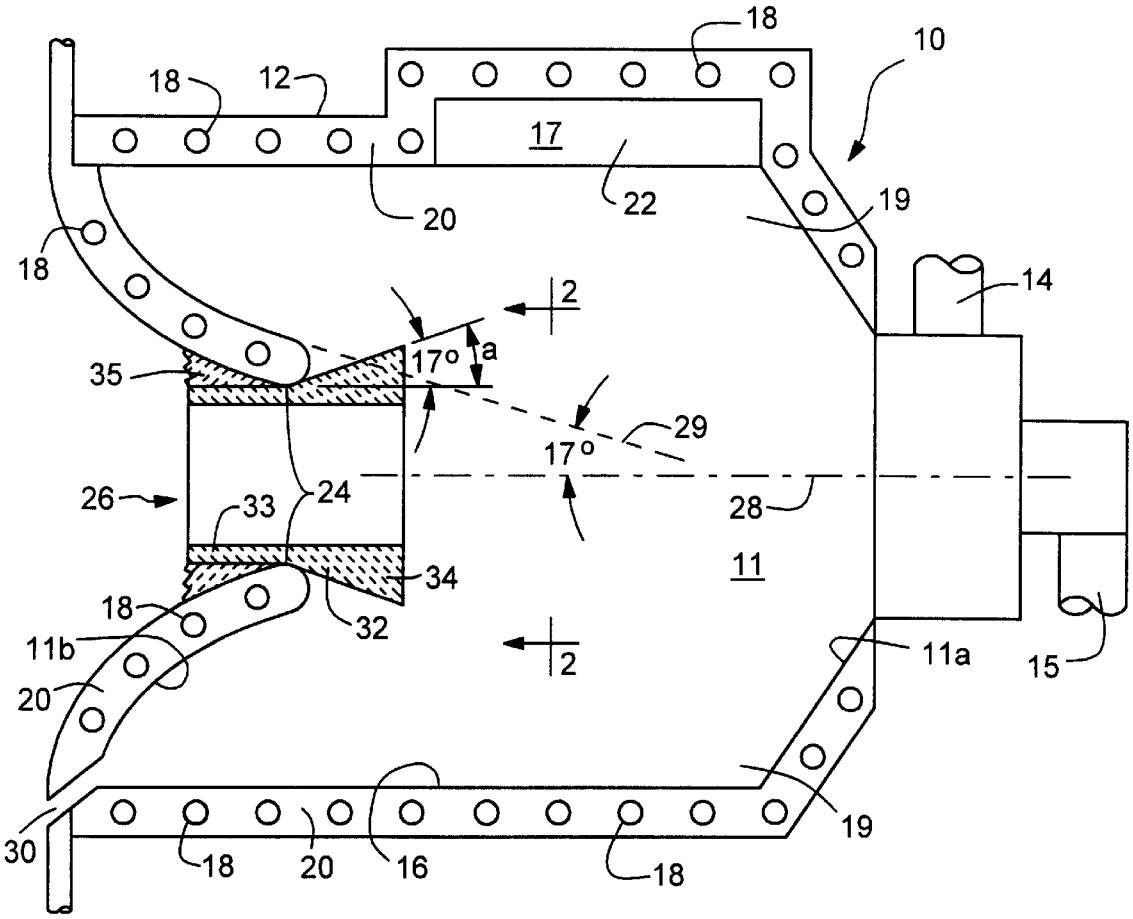
FIG. 1 is a sectional view of a cyclone furnace in accordance with the present invention having the ceramic refractory deflector cone and orifice assembly secured thereto in accordance with the present invention.

Referring now to the drawings where like numerals have been use throughout the several views to designate the same or similar parts, in FIG. 1 there is shown a sectional view of a cyclone furnace or boiler 10 which includes a substantially cylindrical housing 12 which encloses and defines a furnace chamber 11. The cyclone furnace 10 includes a fuel-air inlet opening 14 which permits the introduction into the cyclone furnace of coal and primary air for combustion within the cyclone furnace. A texturing air inlet 15 is provided to facilitate the cyclonic action of fuel and air within the furnace chamber 11 as the crushed coal and primary air are injected into the furnace chamber 11 through inlet opening 14. The cyclonic action of the burning fuel within the chamber 11 continues in process from the forward portion 11*a* of the furnace chamber in a circular helical path, with the burnt coal particles engaging and scrubbing the furnace walls 16 leaving the walls covered with a molten coating of slag.

Embedded within the cylindrical housing 12 of the cyclone furnace are a plurality of water cooling tubes 18 which maintain and control the furnace within predetermined operating temperature ranges. The cooling tubes are covered by a layer of refractory material or lining 20 which provide the furnace walls 16 of the cyclone furnace 10, as well known to those skilled in the art. Secondary air ports 22 extend along the body of the main furnace chamber 11 to enhance the cyclonic action of the fuel-air mixture. The secondary air source 17 is introduced in the same direction of rotation as the primary air-fuel stream within the chamber and is controlled by dampers and deflectors, not shown.

As shown in FIG. 1, the cyclone furnace 10 includes a re-entrant throat portion 24, which defines a gas outlet 26 at the rear end 11*b* furnace chamber 11. The re-entrant throat portion 24 is constructed of the same material as the furnace walls 16, that is, a plurality of water cooling tubes 18 covered with a refractory material 20. In cyclone furnaces, the re-entrant throat portion 24 is arcuately shaped towards the central axis 28 of the furnace 10 to redirect the unburned coal particles towards the central axis 28 of the furnace 10. A slag tap opening 30 is provided in the bottom of the furnace chamber 11 to permit the slag to flow through the opening to control the operating conditions and the efficiency of the furnace 10.

Figure 2:
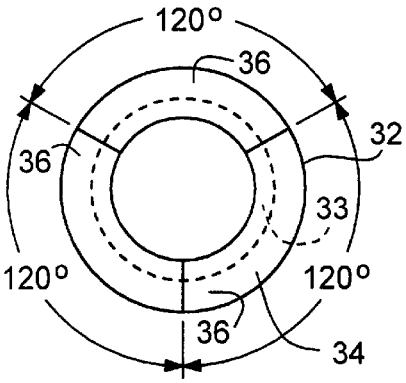
FIG. 2 is a view taken along lines 2—2 of FIG. 1.
Figure 3:
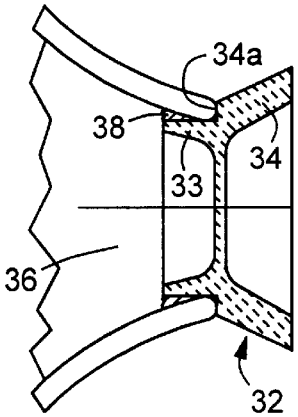
FIG. 3 is an enlarged sectional view of the re-entrant throat and the deflector cone and orifice member in accordance with the present invention.

As shown in FIGS. 1 and 3, a deflector cone and orifice member 32 is provided for insertion into the gas outlet opening 26 to sealingly engage the re-entry throat portion 24. The deflector cone and orifice member 32 includes a first portion 33, which forms a cylinder which is adapted to be received within the re-entrant throat portion 24 of the cyclone furnace and a second deflector portion 34 which is an extension of the throat portion 24 projecting into the furnace chamber at an angle towards the corner 19 of the cyclone furnace. The second deflector portion 34 is cone shaped to deflect the fuel-air mixture to the corner of the cyclone furnace to increase the residence time of the fuel-air mixture and facilitate combustion. The deflector cone and orifice member 32 is molded or cast to a size which is adapted to fit and be supported by the internal diameter of the re-entrant throat portion 24. After the size, width and dimensions of the re-entrant throat portion are known, a mold is made to provide the molded shape of the deflector cone and re-entrant throat member 32. The shape of the mold is designed to provide and mold one or more segments of the monolithic cone and orifice member which segments are structurally arranged to be fitted together and be self supporting within the opening of the re-entrant throat portion 24 by providing a 360 degrees monolithic cone member. As shown in FIG. 2, the deflector cone or orifice member 32 is comprised of three segments 36, which are adapted to be fitted and sized together within the opening of the re-entrant throat portion 24. When the segments 36 are fitted within the re-entrant throat portion, the segments are structurally arranged to be fitted together and self supporting within the opening of the re-entrant throat. As shown in FIGS. 1 and 3, the space between the first cylindrical portion 33 and the re-entrant throat portion 24 may be filled with a refractory material 38 to seal and maintain the cone and orifice member 32 within the re-entrant throat portion 24.

The deflector cone and orifice member 32 is comprised of a ceramic refractory material which has been molded or cast onto one or more segments, which segments, when positioned within the re-entrant throat portion 24, provides the cylindrical monolithic cone and orifice member 32. In FIG. 2, the cone and orifice member 32 is comprised of three segments of approximately 120 degrees each. The use of ceramic refractory materials for molding the cone and orifice member provides improved operating conditions at the gas outlet 26 of the cyclone furnace 10. During combustion, the refractory deflector cone absorbs and retains heat which elevates and sustains the high temperatures at the outlet end thereby providing a more complete burn of the fuel-air mixture as the mixture exits the cyclone chamber. Also, the increased temperature at the outlet end 26 of the cyclone furnace results in an increase in temperature in the vicinity of the slag tap opening 30, thereby facilitating the flow of liquid slag out of the cyclone furnace. Because of the increased resident time of the fuel-air mixture within the furnace chamber 11, it has been found that operating costs may be substantially reduced because of the reduced fuel-air ratio necessary for insertion into the furnace chamber to support combustion. This operating cost reduction is true also due to the reduced volume of unburned fuel exiting the cyclone and contaminating the rear pass of the furnace.

The molded or cast deflector cone or orifice assembly in accordance with the present invention is comprised of a ceramic refractory castable selected from a group comprising chrome containing alumina, zirconia, metals, ceramics and mixtures or blends of each of these materials. It is contemplated by the present invention that the ceramic refractory materials, which are useful in forming the monolithic cone structure must possess resistance to breakdown of about 3600 degrees to be satisfactory for molding the castable refractory cone and orifice member.

Figure 4:
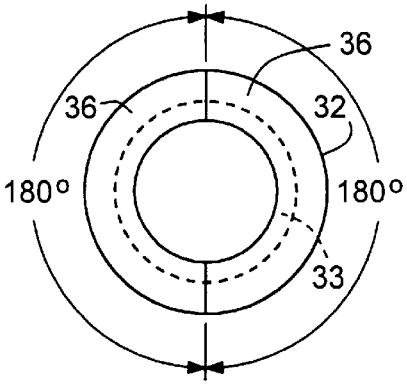
FIG. 4 is a view similar to the view taken along lines 2—2 of FIG. 1 illustrating that the monolithic deflector cone and orifice member is comprised of two segments structurally arranged to be fitted and secured to the re-entrant throat member in accordance with the present invention.

FIG. 3 shows a cross-section of a deflector cone or orifice member which has been inserted into the gas outlet opening 26 and secured to the re-entry throat portion 24. In such a castable refractory, the second deflector portion 34 includes a shoulder 34*a* which abuts against the end of the re-entrant throat portion 24*a*. In FIG. 4 the monolithic deflector cone and orifice member is comprised of two segments structurally arranged to be fitted and secured to the re-entrant throat member.

In FIG. 1, the imaginary extension line 29 extending from the re-entry throat portion and intersects the central axis 28 is generally within an angle range of 15–20 degrees. As shown in FIG. 1, the angle is approximately 17 degrees. It has been determined that the preferred angle "a" for the cone deflector extending away from the ventral axis 28 is substantially within an angle range of 15–20 degrees. As shown in FIG. 1, this angle is shown as approximately 17 degrees. Thus, by positioning the angle of the deflection of the cone deflector at substantially the same angle as the imaginary line 29 extending from the re-entry throat portion and intersects the central axis, enhanced and optimum combustion is achieved in the furnace chamber of the fuel-air mixture.

It is within the scope of the present invention that the deflector cone and orifice member may be installed in existing cyclone furnaces by attachment to the re-entrant throat portion or it may be installed in newly constructed cyclone furnaces by attachment to or as the extension of the re-entrant throat portion.

As described in the present invention, the angle of the re-entrant throat portion extending with respect to the axis 28 of the cyclone furnace 10, is generally between in the range of 15° to 20°. Accordingly, it is sufficient that the outer slope portion of the cone and orifice member of the second deflector portion should have an angle which substantially corresponds to the angle of the re-entrant throat portion. Thus, if the angle of the re-entrant throat portion is 15°, it would be preferred that the angle of the second deflector outer surface of the second deflector portion be substantially 15° to direct the fuel-air combustion mixture back towards the corner of the furnace chamber 11.

What is claimed is:

1. In a cyclone furnace for burning a fuel-air mixture having a cylindrical shaped furnace chamber having an inlet end for the introduction of fuel-air and an outlet end defining a re-entrant throat member, the improvement comprising a monolithic deflector cone and orifice member secured to the re-entrant throat member, with said monolithic deflector cone and orifice member comprised of a castable ceramic refractory material free of cooling tubes therein which maintains the temperature within the cyclone furnace to facilitate burning of the fuel-air mixture.

2. In the cyclone furnace in accordance with claim 1, wherein said ceramic refractory material is selected from a group of refractory materials comprising chrome-containing alumina, chrome-containing zirconia, zirconia, metals and mixtures thereof.

3. In the cyclone furnace in accordance with claim 1, wherein said monolithic deflector cone and orifice member is comprised of at least two segments structurally arranged to be fitted and secured to said re-entrant throat member.

4. In the cyclone furnace in accordance with claim 1, wherein said monolithic deflector cone and orifice member is comprised of three segments structurally arranged to be fitted and secured to said re-entrant throat member.

5. In the cyclone furnace in accordance with claim 1, wherein said monolithic deflector cone and orifice member includes a first portion which is structurally arranged to be secured to said re-entrant throat member and a second portion which provides an extension of said re-entrant throat member into the furnace chamber.

6. In the cyclone furnace in accordance with claim 5, wherein said re-entrant throat member is positioned on the central axis of the furnace and said second portion diverges at an angle of between about 15° to 20° from said central axis.

7. In a cyclone furnace for burning a fuel-air mixture having a cylindrical shaped furnace chamber having an inlet end for the introduction of fuel-air and an outlet end defining a re-entrant throat member, the improvement comprising a monolithic deflector cone and orifice member consisting of a castable refractory material free of cooling tubes therein secured to the re-entrant throat member, with said monolithic deflector cone and orifice member having a deflection slope from the central axis of the furnace chamber substantially the same as the angle of an extension of the re-entrant throat member which intersects the central axis of the furnaces with said castable refractory material maintaining said temperature within the cyclone furnace to facilitate burning of the fuel-air mixture.

8. In cyclone furnace in accordance with claim 7, wherein said monolithic deflector cone and orifice member is comprised of a castable ceramic refractory material.

9. In the cyclone furnace in accordance with claim 8, wherein said ceramic refractory material is selected from a group of refractory materials comprising chrome-containing alumina, chrome-containing zirconia, zirconia, metals and mixtures thereof.

10. In the cyclone furnace in accordance with claim 8, wherein said monolithic deflector cone and orifice member is comprised of at least two segments structurally arranged to be fitted and secured to said re-entrant throat member.

11. In the cyclone furnace in accordance with claim 8, wherein said monolithic deflector cone and orifice member is comprised of three segments structurally arranged to be fitted and secured to said re-entrant throat member.

12. In the cyclone furnace in accordance with claim 7, wherein said monolithic deflector cone and orifice member includes a first portion which is structurally arranged to be secured to said re-entrant throat member and a second portion which provides an extension of said re-entrant throat member into the furnace chamber.

13. In the cyclone furnace in accordance with claim 12, wherein said re-entrant throat member is positioned on the central axis of the furnace and said second portion diverges at an angle of between about 15° to 20° from said central axis.

* * * * *

UNITED STATES PATENT AND TRADEMARK OFFICE

CERTIFICATE OF CORRECTION

PATENT NO. : 6,167,818 B1
DATED : January 2, 2001
INVENTOR(S) : Daniel Dejanovich It is certified that error appears in the above-indentified patent and that said Letters Patent is hereby corrected as shown below:

IN THE DETAILED DESCRIPTION

| Column | Line | |
|---|---|---|
| 3 | 16 | delete "use" insert -used- after been and before throughout; |

IN THE CLAIMS

| Column | Line | |
|---|---|---|
| 6 | 24 | delete "furnaces" insert -furnace,- before with; |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*